United States Patent [19]

Williams

[11] Patent Number: 4,873,757

[45] Date of Patent: Oct. 17, 1989

[54] METHOD OF MAKING A MULTILAYER ELECTRICAL COIL

[75] Inventor: K. Barry A. Williams, Duxbury, Mass.

[73] Assignee: The Foxboro Company, Foxboro, Mass.

[21] Appl. No.: 212,143

[22] Filed: Jun. 27, 1988

Related U.S. Application Data

[60] Division of Ser. No. 70,640, Jul. 8, 1987, which is a continuation of Ser. No. 767,327, Aug. 21, 1985.

[51] Int. Cl.[4] ..... H01F 7/06

[52] U.S. Cl. ..... 29/602.1; 29/852

[58] Field of Search ..... 29/601.1, 846, 852, 29/855

[56] References Cited

U.S. PATENT DOCUMENTS

| | | | |
|---|---|---|---|
| 2,943,966 | 7/1960 | Leno et al. | 154/80 |
| 3,409,805 | 11/1986 | Whipple et al. | 317/101 |
| 3,413,716 | 12/1968 | Sehwertz et al. | 336/232 X |
| 3,765,082 | 10/1973 | Zyetz | 336/200 X |
| 3,798,059 | 3/1974 | Astle et al. | 336/200 X |
| 3,833,872 | 9/1974 | Marcus et al. | 336/200 X |
| 3,848,210 | 11/1974 | Felkner | 336/200 |
| 3,907,565 | 9/1975 | Burton et al. | 96/36.2 |
| 4,012,703 | 3/1977 | Chamberlayne | 336/200 X |
| 4,183,074 | 1/1980 | Wallace | 336/200 X |
| 4,253,079 | 2/1981 | Brosh | 336/84 |
| 4,310,821 | 1/1982 | Frances | 336/200 |
| 4,313,152 | 1/1982 | Vranken | 361/402 |
| 4,342,976 | 8/1982 | Ryser | 336/84 |
| 4,367,450 | 1/1983 | Carillo | 336/200 |
| 4,547,961 | 10/1985 | Bokil et al. | 336/200 X |
| 4,642,160 | 2/1987 | Burgess | 156/630 |

FOREIGN PATENT DOCUMENTS

| | | | |
|---|---|---|---|
| 164435 | 2/1953 | Austria | 336/200 |
| 126169 | 11/1984 | European Pat. Off. | 336/200 |
| 2379229 | 8/1978 | France . | |
| 772528 | 4/1957 | United Kingdom . | |
| 993265 | 5/1965 | United Kingdom . | |
| 1116161 | 6/1968 | United Kingdom | 336/200 |
| 1180923 | 2/1970 | United Kingdom | 336/83 |
| 1494087 | 12/1977 | United Kingdom | 336/200 |

OTHER PUBLICATIONS

"Thick-Film Tranformer Advances Hybrid Isolation Amplifier", Bokil et al., Electronics USA, vol. 54, No. 17, Aug. 25, 1981, pp. 113-117, 336-232.

Crisanti & Desai, "Clip-On Terminals Solve CCC Connection Problems", *Electri. Onics,* Jul. 1984, pp. 21-23.

Malhorta et al., "Finstrate: A New Concept in VLSI Packaging", *Hewlett-Packard Journal,* Aug. 1983, vol. 34, No. 8, pp. 24-26.

*Primary Examiner*—Timothy V. Eley

*Attorney, Agent, or Firm*—Fish & Richardson

[57] ABSTRACT

A monolithic multilayer electrical coil uses advanced printed wiring board technology to create a monolithic component having plural parallel multi turn planar coils interconnected by solid vias of plated metal on a single substrate preferably designed as a surface mounted device.

6 Claims, 9 Drawing Sheets

SY2D
3.5 TURN
LAYER 16

SY2C
3.5 TURN
LAYER 15

SY2B
3.5 TURN
LAYER 14

SY2A
3.5 TURN
LAYER 13

SY1D
1.5 TURN
LAYER 12

SY1C
1.5 TURN
LAYER 11

SY1B
1.5 TURN
LAYER 10

SY1A
1.5 TURN
LAYER 9

PY1D
4 TURN
LAYER 8

PY1C
4 TURN
LAYER 7

PY1B
4 TURN
LAYER 6

PY1A
4 TURN
LAYER 5

SY3C
3.5 TURN
LAYER 4

SY3C
3.5 TURN
LAYER 3

SY3B
3.5 TURN
LAYER 2

SY3A
3.5 TURN
LAYER 1

PLATING MASK LAYOUT

FIG. 21A
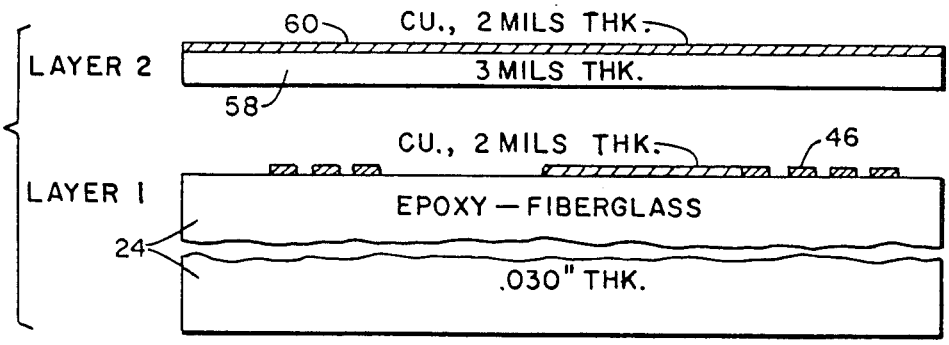
FIG. 21B
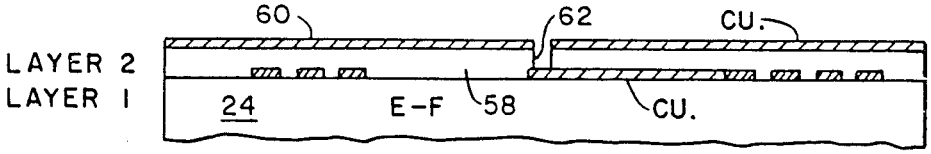
FIG. 21C
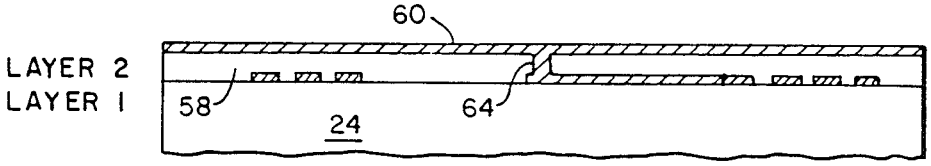
FIG. 21D
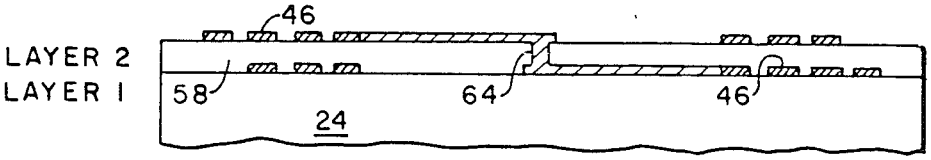
FIG. 22
TABLE I
| LAYER | FIG. | WINDING | TURNS PER LAYER | LAYER NAME | VIA LOCATION (FIG. 18) | TERMINAL CONNECTION (FIG. 18) | VOLTS |
|---|---|---|---|---|---|---|---|
| 16 | 2 | 14 TURN SECONDARY | 3.5 | SY2D | e | 7 | 12 |
| 15 | 3 | | | SY2C | e | 6 | |
| 14 | 4 | | | SY2B | d | 6 | |
| 13 | 5 | | | SY2A | d | 5 | |
| 12 | 6 | 6 TURN SECONDARY | 1.5 | SY1D | a | 12 | ±5 |
| 11 | 7 | | | SY1C | a | 13 | |
| 10 | 8 | | | SY1B | b | 13 | |
| 9 | 9 | | | SY1A | b | 14 | |
| 8 | 10 | 16 TURN PRIMARY | 4 | PY1D | f | 10 | 17 |
| 7 | 11 | | | PY1C | f | 9 | |
| 6 | 12 | | | PY1B | e | 9 | |
| 5 | 13 | | | PY1A | e | 8 | |
| 4 | 14 | 14 TURY SECONDARY | 3.5 | SY3D | d | 3 | ±12 |
| 3 | 15 | | | SY3C | d | 2 | |
| 2 | 16 | | | SY3B | e | 2 | |
| 1 | 17 | | | SY3A | e | 1 | |

METHOD OF MAKING A MULTILAYER ELECTRICAL COIL

This is a divisional of co-pending application Ser. No. 070,640 filed on July 8, 1987, which is a continuation of co-pending application Ser. No. 767,327 filed on Aug. 21, 1985.

CROSS-REFERENCE TO RELATED APPLICATION

The present application is related to application Ser. No. 742,742 and 742,747 entitled "Method of Patterning Resist" and "Multilayer Circuit Board Fabrication Process", respectively, both filed June 10, 1985, by Grandmont and Lake, assigned to the assignee of the present application and incorporated herein by reference.

BACKGROUND OF THE INVENTION

This invention relates generally to the manufacture of magnetic structures and electrical reactive components in particular, multilayer coils employing printed circuits.

The ongoing integration and miniaturization of components in the electronic industry has greatly accelerated the densification of electronic circuitry. Transistors, resistors and capacitors have all but disappeared into integrated circuits, except where discrete devices are required. On the other hand, electrical inductors, i.e., coils and transformers, have not changed as significantly. Simple bulky wire wound coils and transformers abound in modern day electronic circuitry, mingling with far smaller integrated circuits of almost incredible complexity. Although coils see use as radio frequency chokes and filters, the most frequent applications are for motive power by magnetic attraction (motors and solenoids) and, of course, for transformers. Transformers serve in AC and pulse circuits as power supply components, isolation devices and electromagnetic The present application focuses on coils as used for transformers in power supplies, for example, in DC to DC converters. However, there are many other applications. The heaviest bulkiest component of most power supplies is the transformer. Thus, miniaturization of the power supply depends on miniaturization of the transformer. The power supply of the future will be a surface mount device attached to a printed circuit board just like integrated circuit component. Present day bobbin wound transformers are incompatible with surface mount technology. Moreover, because of the lack of uniformity in the winding operation, parameters of nominal inductance, self-resonance, leakage inductance and self-capacitance, for example, are relatively difficult to control to tight tolerances.

In the past, there have been attempts to make multilayer coils which have not met with great success because of limitations in the manufacturing procedures. It is known, of course, to make a planar spiral type coil conductor pattern on a printed circuit board. The prior art also suggests stacking of a number of separately manufactured planar coil substrates and interconnecting the planar coil layers. The manufacturing obstacles and interconnection technology, however, leave much to be desired.

SUMMARY OF THE INVENTION

Accordingly, the general object of the invention is to create a low cost miniaturized monolithic multilayer coil component with improved manufacturability. Another object is to create a monolithic coil component compatible with surface mount technology.

These and other objects of the invention are achieved by exploiting advanced multilayer printed wiring board technology to create a surface mountable monolithic component on a single substrate with integral reactive devices.

In preferred embodiments, the coil layers are built on the substrate, using the techniques disclosed in the co-pending "multilayer" application referenced above to create plural layers of planar multi-turn coils interconnected by solid metal plated vias. According to one embodiment of the invention, coil layers are separated by insulating film plating masks of generic design. Each plating mask has apertures in predefined locations to form taps and interlayer connections by plating through the plating mask. In the preferred embodiment, plated outer coil connection posts extend all the way through the multilayer structure. The resulting magnetic component--whether a simple inductor, a series of cross-coupled inductors mounted on a core or a complex transformer—can be designed so that surface mount clips engage pads on a protruding edge of the substrate. In one embodiment, however, the substrate is expanded to full printed wiring board size to accommodate other components which can be connected to the coil terminals by printed circuitry. In this embodiment, the coil is integrated with the printed wiring board which carries other components.

The foregoing techniques result in miniature surface mountable power supply transformers and other reactive components which are easy to standardize and manufacture using advanced printed circuit board techniques.

BRIEF DESCRIPTION OF THE DRAWING

FIGS. 21A–21D show sectional views of the manufacturing process for layers 1 and 2 indicated in FIG. 19.

FIG. 22 is a table tabulating the coil layers.

DESCRIPTION OF THE PREFERRED EMBODIMENTS

Figure 1:
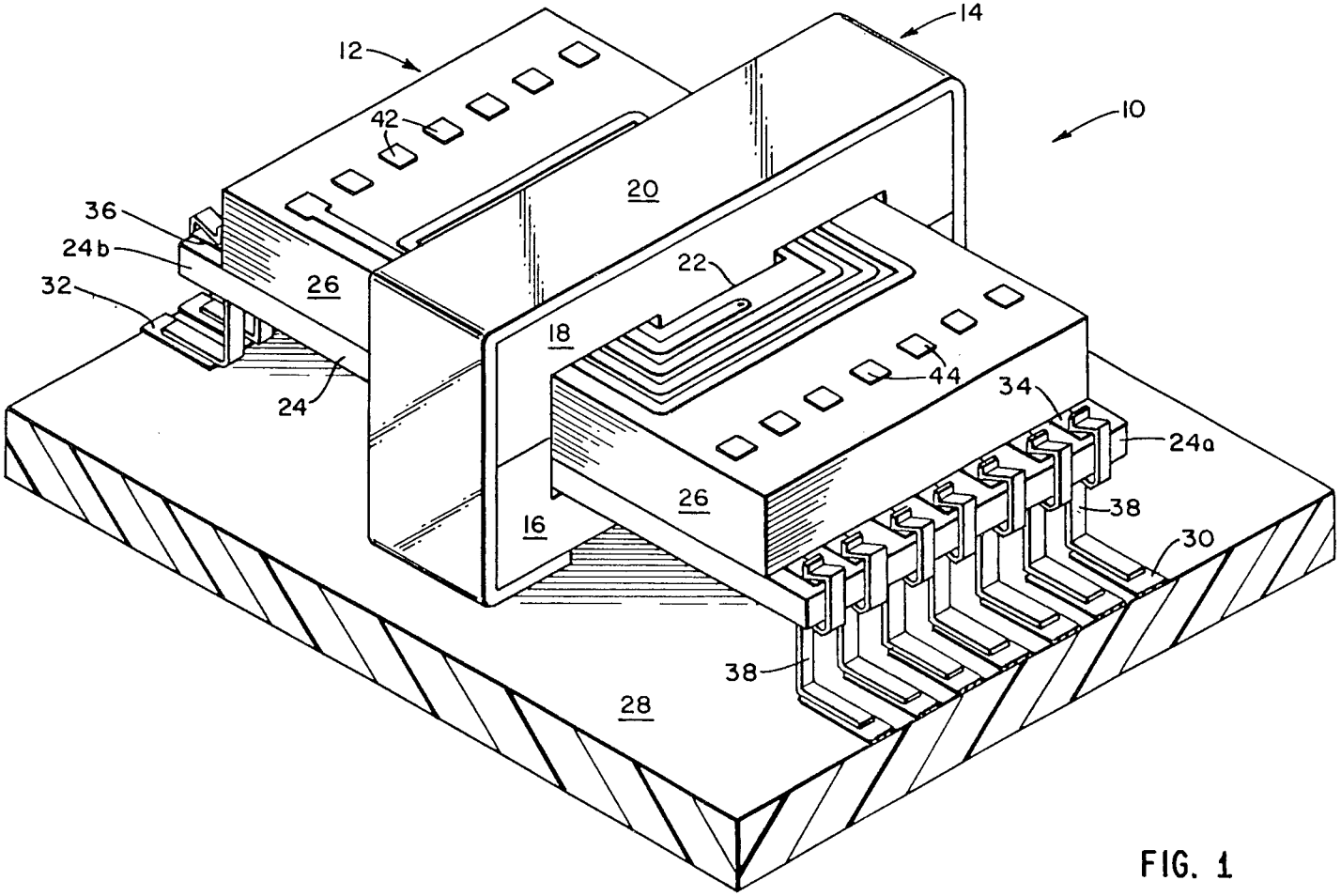
FIG. 1 is a perspective view of a surface mounted transformer constructed according to the invention.

The following description provides an example of the invention in the form of a specific transformer. The transformer 10 shown in FIG. 1 is designed for a dual supply, quad output 15 watt DC to DC converter represented schematically in FIG. 23. This type of power supply is designed to produce several outputs at different levels to power both analog and digital portions of instrumentation or computer equipment, for example. While the invention is particularly suited for transformers for small power supplies, the invention is applicable to other devices as well, for example, magnetic devices such as solenoids and motors as well as inductors for electronic circuitry.

In FIG. 1, the transformer 10 comprises a monolithic multilayer printed wiring board (PWB) 12 and a ferrite core assembly 14 comprising two opposed E-shaped sections 16 and 18 secured by a metal clip 20. The center leg (typically 0.125×0.125 inch square) of the resulting E-core assembly 14 is received in a square hole 22 which extends all the way through the PWB 12 such that the back and end portions of the E-core assembly 14 surround the mid-section of the multilayer PWB 12. The PWB 12 itself comprises preferably an epoxy fiberglass lower substrate 24 supporting a series of parallel, bonded thin film insulating layers in which interconnected planar spiral coils are embedded as described below. The substrate 24 and multilayer structure 26 are bonded together to form the integral multilayer PWB 12.

The transformer 10 shown in FIG. 1 is designed for surface mounting on another larger PWB 28 carrying a conductor pattern and other surface mount devices (not shown). The printed conductor pattern carried by the larger PWB 28, which may also be a multilayer PWB if desired, includes two sets of parallel terminal pads 30 and 32. The substrate 24 in FIG. 1 is designed to be slightly longer, in the direction normal to the plane of the E-core 14, than the overlying multilayer structure 26 so as to present protruding end portions **24*a* and 24*b* with respective sets of terminals 34 and 36 corresponding respectively to the terminal pads 30 and 32 on the PWB 28. Surface mount clips 38 of compliant metal are soldered to the terminal pads 30 and 32 on the PWB 28 and engage the protruding edges 24*a* and 24*b* of the substrate, making contact with the respective terminals 34 and 36. The thickness of the substrate 24 is determined by the surface mount clips that will be attached to the outer ends of the board. The clips 38 thus connect the transformer 10 to the PWB 28** both electrically and mechanically.

The multilayer structure 26 includes sixteen separate planar spiral coil layers as shown in FIGS. 2–17. The layers are numbered 1 through 16 from the bottom to the top. The coils are organized in groups of four adjacent coils such that there are four windings comprising one primary and three secondary windings, their organization being shown in Table I (FIG. 22).

Figure 2:
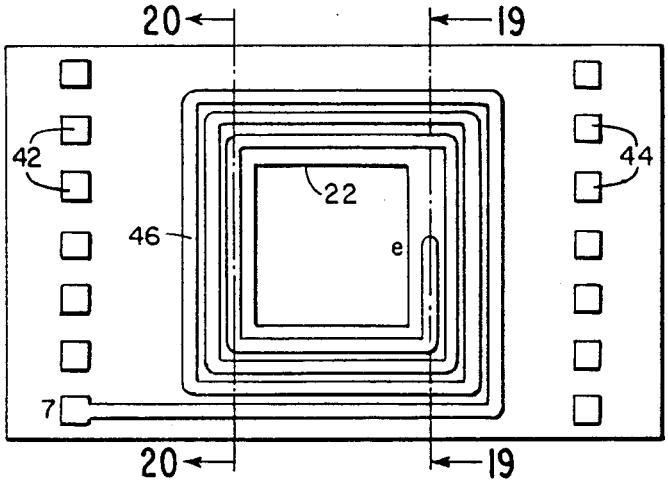
FIGS. 2–17 are a series of plan views showing respective circuit patterns for each layer of a transformer having three secondaries designated SY1, SY2 and SY3 and one primary designated PY1, constructed according to the invention.

The top layer, layer 16, is shown in FIG. 2 in plan and is also visible in the view of FIG. 1. The conductive pattern is represented by the enclosed squares and strip-like paths indicated inside the overall rectangular layer. Each layer includes two parallel rows of seven terminal posts 42 and 44. Terminals 42 are numbered 1 through 7 from top to bottom as viewed in FIG. 2, for example. Terminals 44 are numbered 8 through 14 from top to bottom as viewed in FIG. 2. These terminal posts 42 and 44 extend all the way through the multilayer structure 26 to the substrate board 24. Terminals 42 and 44 thus form parallel rows of vertical posts. Posts 42 and 44 are connected respectively to terminals 36 and 34 on the protruding edges **24*b* and 24*a*** of the substrate.

Each of the top four layers making up the second secondary winding, layers 13–16 in FIGS. 2–5 includes a three and a half turn spiral planar conductive path 46 around the hole 24 for the center leg of the E-core 14 (FIG. 1). Within each group of planar coils, the coils 46 in adjacent layers are interconnected through vertical vias of conductive metal embedded in the multilayer structure.

Figure 3:
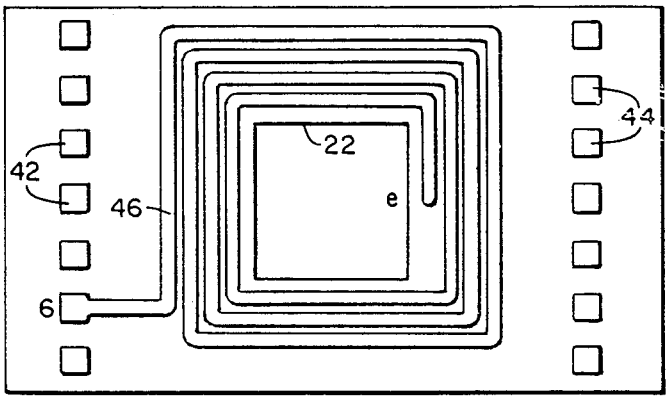
Figure 18:
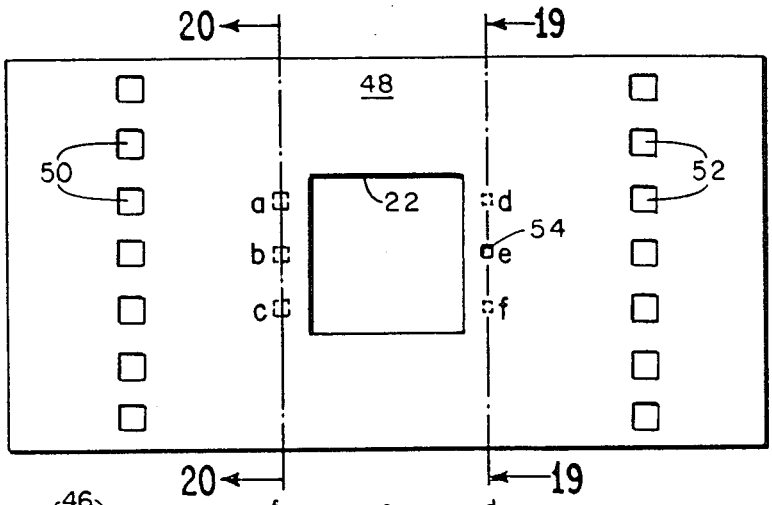
FIG. 18 is a plan view of the generic plating mask layout according to the invention.

The vias are plated through thin film insulating layers referred to as plating masks. Each plating mask is formed by a rectangular film of insulating material having 14 square apertures in two rows 50 and 52 through which the vertical posts 40 and 42 are plated and, in some cases, a single inner via window 54 at one of six locations lettered a through f in FIG. 18 lying next to the core hole 22. Locations a, b and c are in a row parallel to and between terminal post windows 50 and the hole 22. Window locations d, e and f are in a row parallel to and between terminal holes 52 and core hole 22. FIG. 18 shows the case where an inner via plating window 54 is at location e. As shown in FIG. 2, location e is the inner terminus of the spiral 46. Spiral 46 begins at terminal post 7 in layer 16 and ends after three and half turns around the core at inner via location e. As shown in FIG. 3, layer 15, the next layer down, has a spiral 46 which begins at inner via location e and ends at terminal post 6. The plating mask shown in FIG. 18 with a window at e is interposed between layers 16 and 15. During manufacture the plating mask 48 of FIG. 18 would be placed on top of the patterned layer 15 and metal, preferably copper, would be plated up through the terminal post holes 50 and 52 from the underlying metal sites at 42 and 44 and simultaneously through the inner via window 54 from the underlying inner end of coil 46 at location e. The plating mask between layers 14 and 15 requires no inner via window because the interconnection between the coils in layers 14 and 15 is through outer terminal post 6.

Figure 4:
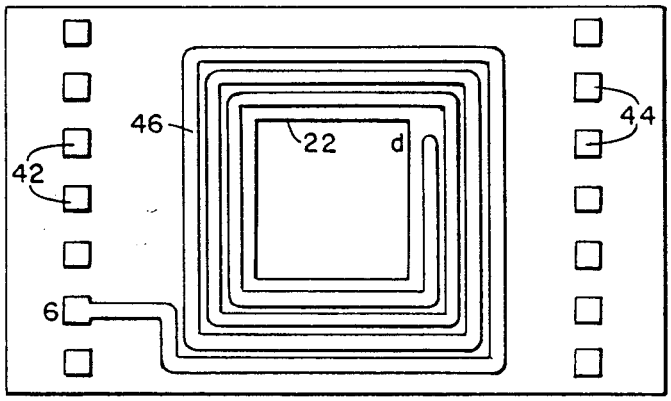
Figure 5:
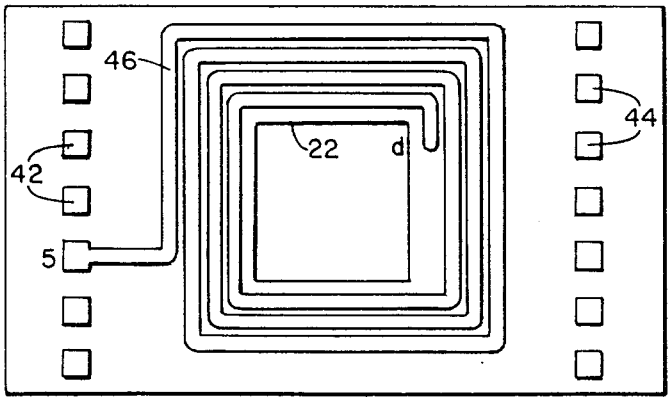
Figure 6:
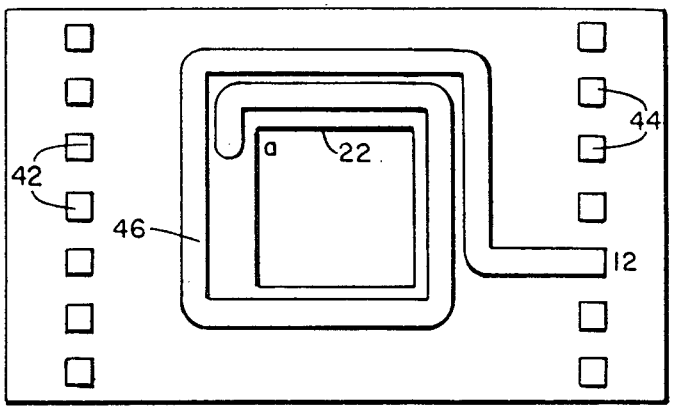

The remaining interconnection of layers 14 and 13 would be through a plating mask like mask 48 of FIG. 18 except that the inner via window 54 would be located at d as indicated in FIGS. 4 and 5 so as to interconnect the coils in layers 14 and 13 at inner location d. Because of the symmetrical arrangement of the four coils making up the secondary winding in FIGS. 2–5, terminal post 6 represents a center tap while terminal posts 5 and 7 represent terminals on opposite ends of the winding.

Figure 7:
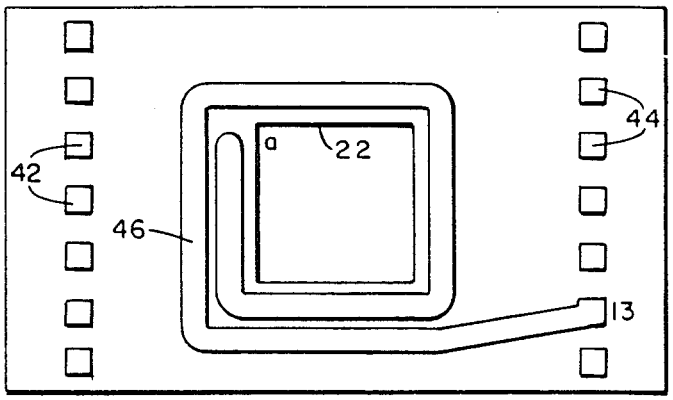
Figure 8:
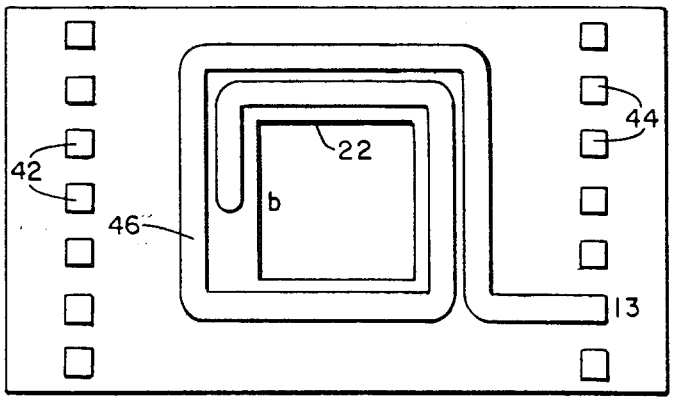
Figure 9:
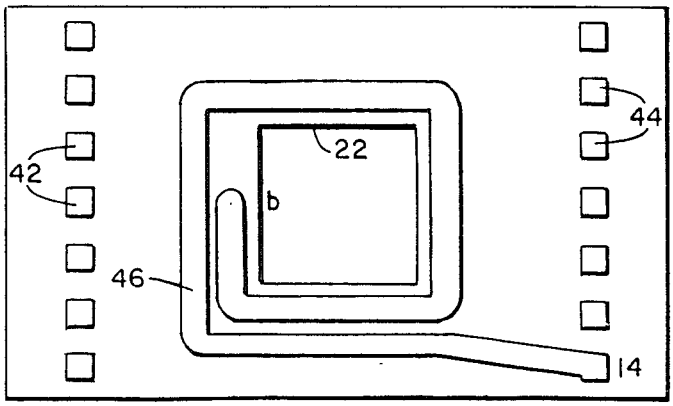
Figure 10:
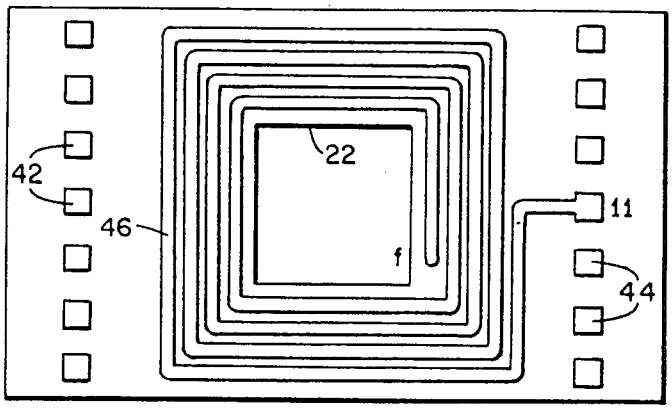
Figure 11:
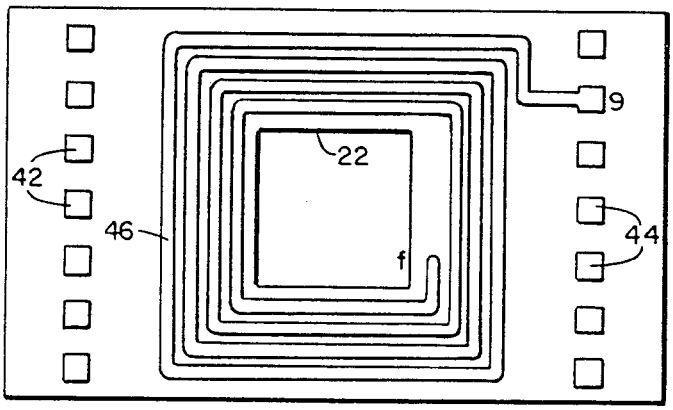
Figure 12:
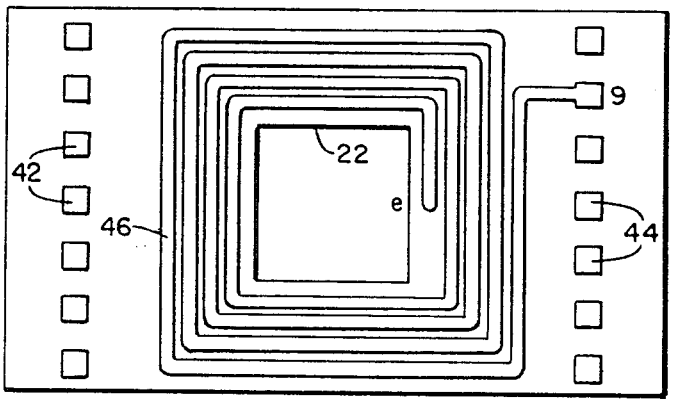
Figure 13:
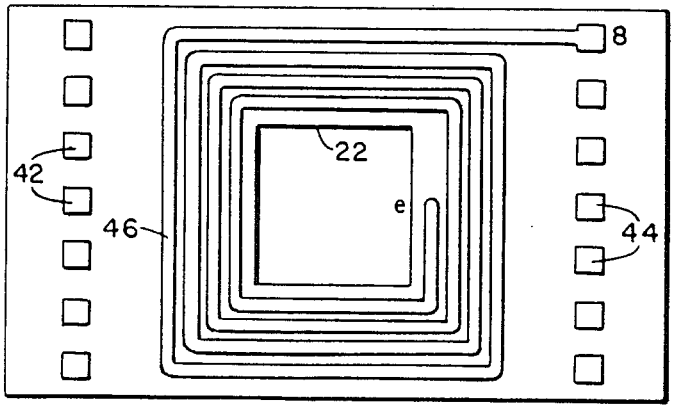
Figure 14:
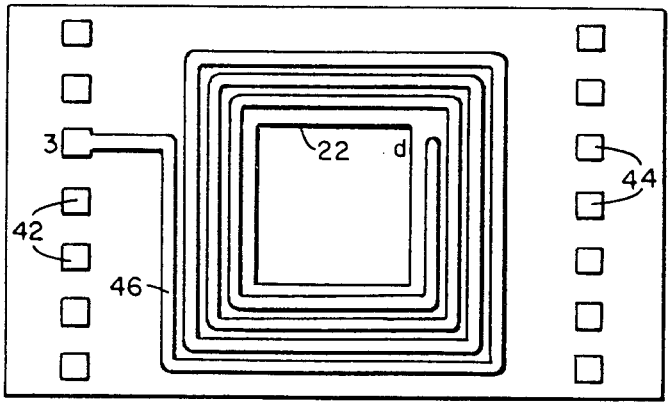
Figure 15:
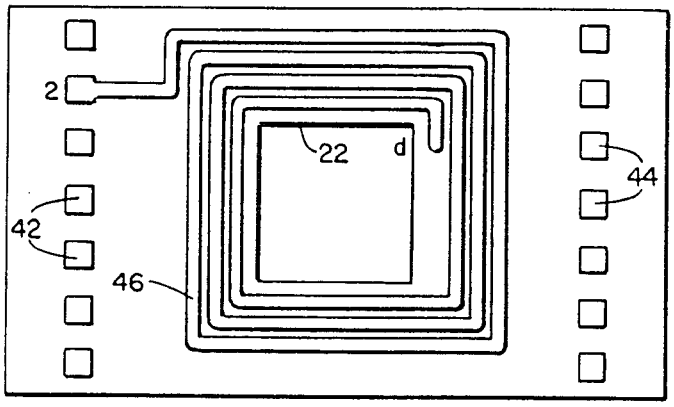
Figure 16:
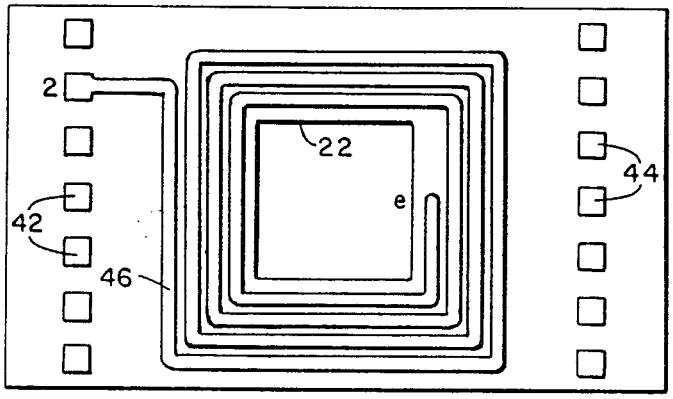

The other three windings are implemented in a similar fashion although the number of turns differs for the primary and first secondary winding. In particular, the first secondary comprising the four coils shown in FIGS. 6–9 has a total of six turns, one and a half turns per layer. Layers 12 and 11 are interconnected through a plating mask having an inner via window at location a. Layers 11 and 10 in FIGS. 7 and 8 are connected through an inner windowless plating mask at post 13, forming a center tap. Layers 10 and 9 in FIGS. 8 and 9 are connected through a plating mask having an inner window at location b. The plating mask between windings, that is, between layer 13 and 12 of FIGS. 5 and 6, for example, is an inner windowless plating mask having only the fourteen post holes. The same would be true for the other two interwinding plating masks.

Figure 19:
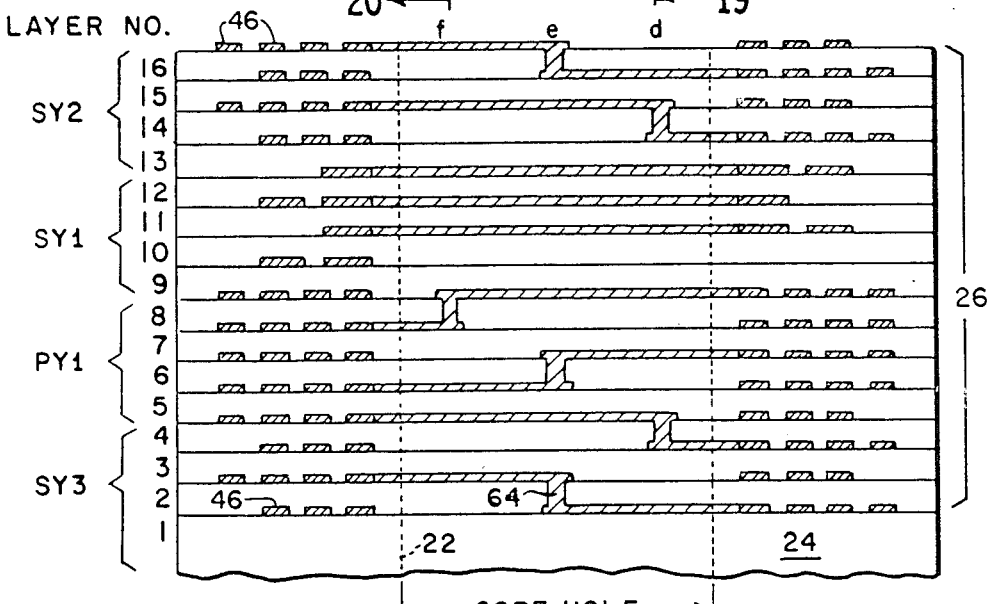
FIG. 19 is a cross-sectional view of the multilayer coil structure taken in a plane indicated by lines 19—19 of FIGS. 2 and 18.
Figure 20:
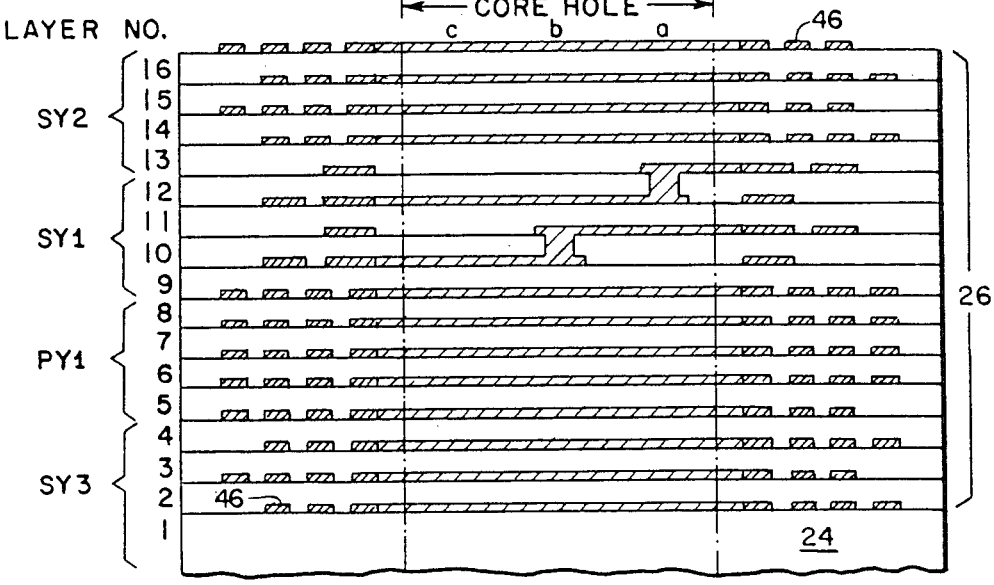
FIG. 20 is a cross-sectional view of the multilayer coil structure of FIG. 1 taken in a plane indicated by lines 20—20 of FIGS. 2 and 18.

The sectional views shown in FIGS. 19 and 20 illustrate the embedded structure of the multilayer coils. The vias are illustrated as interlayer passthroughs adjacent the core hole 22. Note that with the exception of the first secondary winding (layers 9–12) all of the inner via locations lie on the right-hand side of the core hole 22 as viewed in FIG. 18 (locations d, e and f) and are, therefore, picked up in FIG. 19. The one and a half turn coils of the first secondary (layers 9–12) have inner via connections at locations a and b shown in FIG. 20.

The multilayer structure 16 can be fabricated using either of the alternate techniques of FIG. 1 and FIG. 8 of the copending multilayer application Ser No. 742,747 incorporated by reference. The technique of FIG. 1 of the copending multilayer application involves fabrication of composite structures each having a trace pattern of very thin conductive metal foil supported on a photoprocessible insulating film, preferably permanent dry film (PDF). The composite is bonded foil pattern side down to the substrate or preexisting multilayer structure and selected areas of PDF are removed by photoprocessing down to underlying metal sites for electroless plating. All of the apertures in the insulating film are then electrolessly plated full of metal flush to the upper surface.

Using the composite PDF process, each coil layer is formed by electrolessly plated conductors which become embedded in a coil layer of insulating PDF. The layers between coil layers such as the plating mask of FIG. 18 do not have new conductor patterns in them and, therefore, do not need to have a trace pattern of conductive metal foil applied first to the PDF. This is because the plating sites are provided by the immediately subjacent layer. Thus, the PDF plating mask between coil layers is photoprocessed after application to the multilayer structure in order to open plating windows 50, 52 and 54. The next coil layer would be applied in the form of a foil trace pattern/PDF composite bearing the design of the next higher coil layer.

In the alternate process, a foil clad composite is bonded to an existing substrate foil side up, unlike the PDF composite process. The insulating layer is selectively etched (e.g., by plasma) through windows photoetched in the top foil layer. The voids in the insulator layer expose copper sites on the underlying structure. The voids are plated full of metal to form vias and the foil layer is photoetched to make a conductor pattern. The process is repeated to make multiple layers.

Because it is somewhat easier to illustrate, the alternate process is shown in FIGS. 21A–D. In addition, FIGS. 19 and 20 show the infrastructure of the multilayer coil resulting from use of the alternate technique in which the conductors making up the planar coil are formed primarily by the foil cladding rather than by electroless plating.

Figure 17:
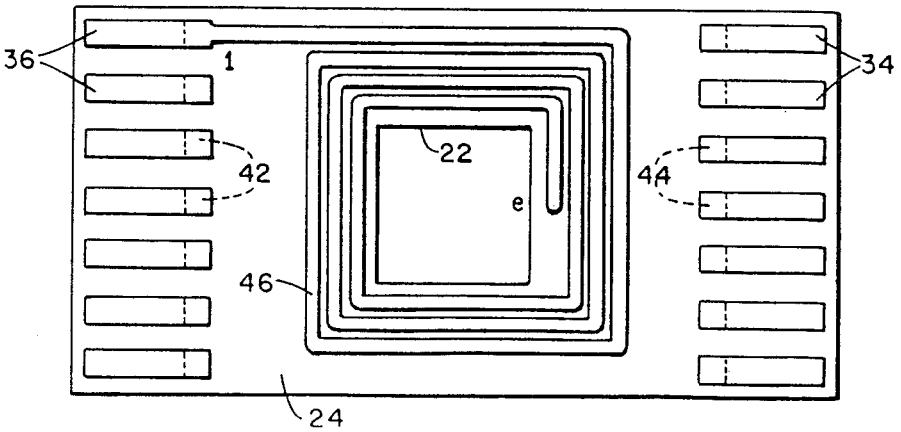

As indicated in FIG. 21A, the first step in the process is to provide a conductor pattern on the epoxy fiberglass substrate 24. The coil pattern for layer 1 can be configured using any of a number of known photoresist techniques, pattern plating being preferred. However, the resulting pattern should not be left coated with tin but should be bare copper. As shown in FIG. 21A, layer 2 is first applied in the form of an insulating material, which may be a thermoplastic such as DuPont Teflon® FEP or RTV synthetic rubber on the order of 3 mils thick. A copper cladding layer 60 on the top is preferably about 2 mils thick. Insulating layer 58 is then bonded to the patterned surface of the substrate 24 as shown in FIG. 21B and via windows are opened in the insulating material after photoetching the via sites in the copper foil. Only via windows 62 at location e is shown in this cross-section. However, the fourteen post hole via windows would also be opened in the insulating layer 58 at this time. Next, in FIG. 21C, window 62 is plated full of copper from the underlying coil terminus at via location e as shown in FIG. 17. The existence of copper at the bottom of the window 62 facilitates plating. A flash coating of electroless copper can be provided on the inner walls of the aperture 62 to make electrical contact between the foil cladding 60 and the metal window bottoms so that electroplating can be used if desired. In any event, a solid copper via 64 is formed as shown in FIG. 21C. The remaining step is to photoetch the next coil layer 46 in the copper cladding layer 60, the result being shown in FIG. 21D.

The next layer, layer 3 as shown in FIG. 19, would be added in a similar manner by applying another foil clad composite (insulator 58 and cladding 60) as shown in FIG. 21A. Note that layer 3 does not require an inner via, but does require the post hole via windows to be opened up and plated through.

The relative merits, with respect to the present invention, of the two alternative fabrication processes disclosed in the multilayer application will be determined by the particular coil design requirements. However, it is expected that the alternate process involving a thin insulating film with a relative thick cladding layer may be somewhat simpler given the fact that the coil layer is carried on the back of the plating mask in one composite structure. That is, the number of separate insulating layers is reduced.

The transformer 10 of the foregoing description is specifically designed for use in a voltage fed switching power supply for a quad output 15 watt (total output), DC-DC converter. The outputs of the transformer as tabulated in FIG. 22 are +5 volts at 1.5 amps, −5 volts at −0.05 amps, ±12 volts at 0.18 amps, and plus +12 volts at 0.10 amps.

Figure 23:
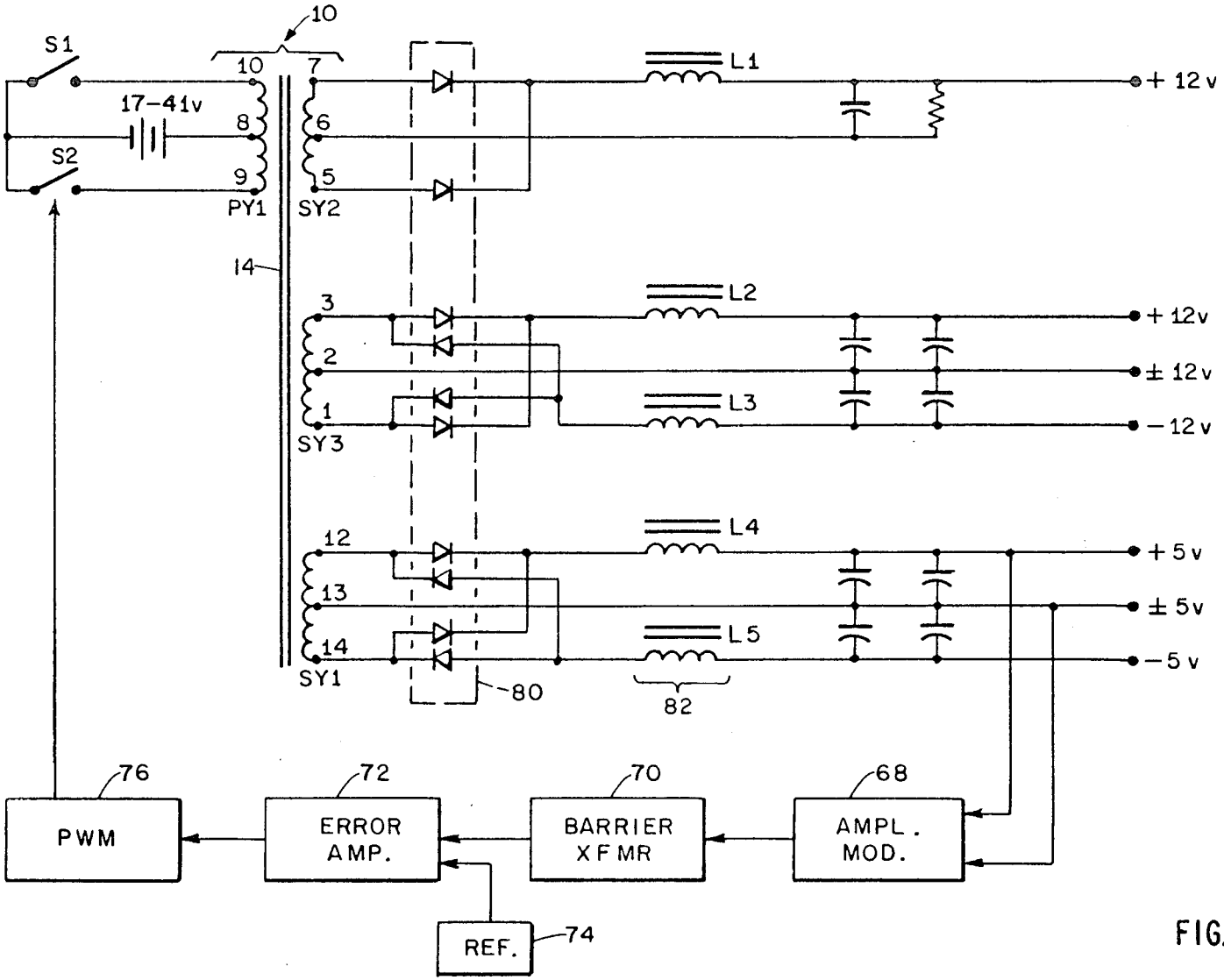
FIG. 23 is an electrical schematic and block diagram of a DC to DC converter having a transformer constructed according to the invention.

As shown in FIG. 23, input power for the DC-DC converter is supplied by a 17 to 41 volt DC source connected from the center tap of primary winding PY1 (FIGS. 10–13). The other side of the DC source is connected to the terminals of the primary winding via electronic switches S1 and S2, respectively as shown. The winding terminals 9 and 10 and center tap 8 indicated in FIG. 23 designate the corresponding vertical terminal post in the multilayer structure 26 of FIGS. 2–17. The three secondary windings are connected as shown through complementary diode networks 80 acting as rectifiers to respective cross-coupled inductors 82 (L1 through L5) which act as ripple attenuators, followed by parallel capacitive networks as shown in FIG. 23, to produce the indicated voltages corresponding to the Table of FIG. 22. A feedback loop controls switches S1 and S2. In particular, the first secondary winding supplies a signal from the +5 volt side referenced to the center tap 13. This input signal is applied to amplitude modulator 68 which uses variations in the input signal to modulate the amplitude of a 5 MHz carrier to generate isolated feedback. Preferably an integrated circuit (UC3901) is employed for amplitude modulator 68. The output of modulator 68 is fed via a barrier transformer 70 for further isolation to an error amplifier 72 which compares the output of the barrier transformer 70 with a reference 74. The error signal is fed to a pulse width modulator circuit 76 (e.g., integrated circuit (UC3825)) which electronically actuates switches S1 and S2 in a well known overlapping periodic fashion (typically at 1 MHz), the duty cycles varying in order to maintain the 5 volt output constant.

The cross-coupled inductors 82 (L1–L5) of FIG. 23 can be implemented in a multilayer structure constructed in the same manner as transformer 10.

Figure 24:
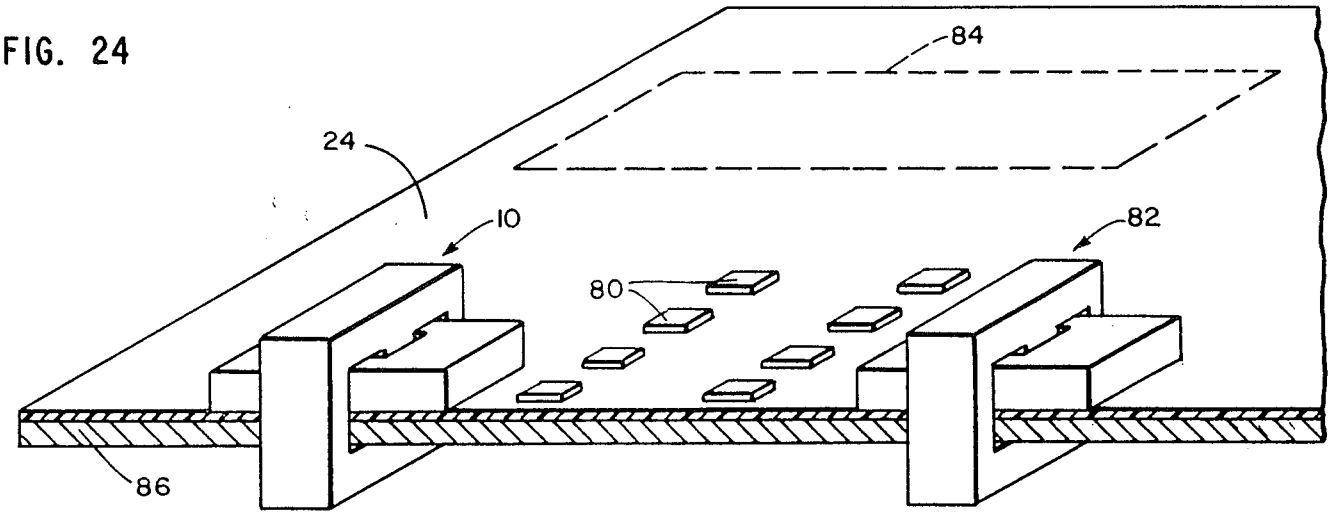
FIG. 24 is a perspective view with portions broken away of multilayer coil structures constructed according to the invention on a common printed wiring board which carries other components, according to another aspect of the invention.

As shown in FIG. 24, the substrate 24 of FIG. 1, instead of being attached by clips or other means to another underlying PWB, can be extended to form a PWB 24' for other components, for example, surface mounted diodes 80 as shown. Indeed, the cross-coupled inductor set 82 can share the same substrate 24' with the transformer 10 if desired. The remainder 84 of the components of the DC-DC converter of FIG. 23 can also be mounted on the PWB substrate 24'. The remainder of the components includes the controller chip PWM, power FET's for switches S1 and S2 and the error amplifier chip and amplitude modulator chip. The chips can be in die form connected to the substrate 24' by wire bonding with 1 mil gold wire. Thus, the printed wiring board 24' carrying other components is integral with one or more coil structures, for example, transformer 10 and cross-coupled conductors 82. Enhanced heat dissipation can be obtained by using a substrate 24' with copper cladding on both sides to form a metal layer 86 on the bottom which serves as a heat sink. For best operation, the metal layer 86 is attached directly to a metal chassis wall for further heat dissipation.

The foregoing coil structure outperforms bobbin wound transformers and coils in a number of areas. The multilayer coil structure has greatly reduced size and is configured appropriately for surface mount applications. The resulting structure has very low leakage inductance due to layering, but has large self capacitance. As frequencies of operation increase, it is desirable also to minimize lead length to reduce radiated RF energy, another objective achieved by the design of the foregoing description. Moreover, complex transformer geometries with multiple secondaries are easy to fabricate by the new technique. However, one of the most important results of the present design is that it enables more standardized, uniform manufacturing, thus allowing more consistent quality control, higher reliability and ultimately lower cost.

The option of extending the first layer substrate 24 to accommodate other components, as shown in FIG. 24, integrates transformer and printed circuit board thus eliminating the need for separate connectors. That is, the conductor pattern on the substrate can be easily designed to lead right into the coil terminals and center taps by joining up with the conductor paths 34 and 36 in the first layer.

The other type of reactor components, namely, capacitors, can also be implemented in a similar fashion. As shown, for example, in layers 1–8 of FIG. 20, parallel conductive plates can be formed on adjacent layers and ganged together by interconnecting the plates in every other layer by means of the vertical post terminal technique.

The specific embodiment disclosed herein, of course, is merely for illustration, many variations and modifications being possible without departing from the spirit or scope of the invention. For example, the epoxy fiberglass substrate can be advantageously replaced in some applications by a ceramic substrate. Coil geometries and interconnection points are unlimited by the present technique. For example, the present invention is not limited to planar spiral coil layers. Each layer may be a single turn if desired with the vias progressively staggered or offset. Nor is the ferrite core an essential part of the invention as a coreless inductor coil can be implemented using the same technique. While transformers and inductors for electronic circuitry are desirable applications for the present invention, many other uses are possible. For example, in magnetic devices such as motors, generators, alternators, rotary or linear actuators or solenoids, and voice coils, the electromagnetic coils can be implemented according to the invention. The scope of the invention is indicated by the appended claims and equivalents thereto.

What is claimed is:

1. A thin film additive method of fabricating a multi-planar-coil winding for an inductive component, comprising the steps of patterning a first insulating film layer with a continuous spiral planar channel, and a plurality of outer apertures outside said spiral, the inner end of said spiral channel terminating at a first one of a predetermined plurality of inner locations distributed about a central section of said layer, the outer end of said spiral channel terminating at a first one of said outer apertures, plating the channel and apertures of said first layer full of conductive metal to form a first coil, bonding a second thin film insulating layer over said first layer, forming in said second insulating layer, a plurality of outer apertures in registration with the outer apertures of the first insulating layer, and a single inner aperture at said first location in registration with the inner end of the conductive spiral defined in said first insulating layer, plating the apertures in said second layer full of conductive metal, bonding a third thin film insulating layer over said second layer, patterning said third insulating layer with a second planar spiral channel having an inner end terminating in registration with said inner aperture in said second insulating layer and a plurality of out apertures in registration with the outer apertures in said first and second insulating layers, the outer end of said spiral channel terminating at a second one of said outer apertures, and plating said apertures and channel in said third layer full of conductive metal to form a second coil, whereby, a monolithic thin film multi-planar-coil winding is formed with the outer ends of each planar coil being connected to solid metal plated posts extending through the layers.

2. The method of claim 1, further comprising defining a central hole through the multilayer structure for receiving a magnetic core member.

3. The method of claim 1, wherein the step of bonding each of the odd-numbered ones of said thin film insulating layers is preceded by and includes preparing and applying a patterned thin-film composite according to the following steps applying a conductive metal foil to a thin film insulating material to form a composite, patterning the metal foil on the composite, and applying the composite on top of the preceding even-numbered thin film insulating layer to form the respective odd-numbered insulating layer so that the patterned metal foil on the composite is adjacent to the underlying even-numbered thin film layer to provide conductive metal sites for plating up through the respective odd-numbered insulating layer.

4. A thin film additive method of fabricating a multi-planar-coil winding for an inductive component, comprising the steps of patterning a first insulating film layer with a continuous spiral planar channel, and a plurality of outer apertures outside said spiral, the inner end of said spiral channel terminating at a first one of a predetermined plurality of inner locations distributed about a central section of said layer, the outer end of said spiral channel terminating at a first one of said outer apertures, plating the channel and apertures of said first layer full of conductive metal to form a first coil, bonding a second thin film insulating layer over said first layer, forming in said second insulating layer, a plurality of outer apertures in registration with the outer apertures of the first insulating layer, and a single inner aperture at said first location in registration with the inner end of the conductive spiral defined in said first insulating layer, plating the apertures in said second layer full of conductive metal, bonding a third thin film insulating layer over said second layer, patterning said third insulating layer with a second planar spiral channel having an inner end terminating in registration with said inner aperture in said second insulating layer and a plurality of out apertures in registration with the outer apertures in said first and second insulating layers, the outer end of said spiral channel terminating at a second one of said outer apertures, plating said apertures and channel in said third layer full of conductive metal to form a second coil, bonding a fourth insulating layer over said third layer, patterning said fourth insulating layer with a plurality of outer apertures in registration with the outer apertures of the underlying layers, plating the apertures in said fourth layer full of conductive metal, bonding a fifth thin film insulating layer over said fourth insulating layer, patterning said fifth insulating layer with a plurality of outer apertures in registration with the outer apertures of the underlying layers and a spiral channel having an outer end terminating at said second location of said outer apertures and an inner end terminating at a second one of said predetermined inner locations about the corresponding central section, plating the channel and apertures of said fifth layer to form a third coil, bonding a sixth thin film insulating layer over the fifth insulating layer, patterning said sixth insulating layer with a plurality of outer apertures in registration with the outer apertures of the underlying layers and an inner aperture at said second location, plating the apertures of said sixth layer with solid conductive metal, bonding a seventh thin film insulating layer on top of said sixth thin film insulating layer, patterning said seventh thin film insulating layer with a plurality of outer apertures in registration with the outer apertures of the underlying layers, a spiral channel having an outer end terminating at a third location of one of said outer apertures and an inner end terminating at said second location, plating the channel and apertures of said seventh layer full of conductive metal to form a fourth coil, whereby, a monolithic thin film multi-planar-coil winding is formed with the outer ends of each planar coil being connected to solid metal plated posts extending through the layers.

5. The method of claim 4, further comprising defining a central hole through the multilayer structure for receiving a magnetic core member.

6. The method of claim 4, wherein the step of bonding each of the odd-numbered ones of said thin film insulating layers is preceded by and includes preparing and applying a patterned thin-film composite according to the following steps applying a conductive metal foil to a thin film insulating material to form a composite, patterning the metal foil on the composite, and applying the composite on top of the preceding even-numbered thin film insulating layer to form the respective odd-numbered insulting layer so that the patterned metal foil on the composite is adjacent to the underlying even-numbered thin film layer to provide conductive metal sites for plating up through the respective odd-numbered insulating layer.

* * * * *

UNITED STATES PATENT AND TRADEMARK OFFICE

CERTIFICATE OF CORRECTION

PATENT NO. : 4,873,757

DATED : October 17, 1989

INVENTOR(S) : K. Barry A. Williams

It is certified that error appears in the above-identified patent and that said Letters Patent is hereby corrected as shown below: On the title page:

In the References Cited: "3,409,805 11/1986 Whipple et al." should be --3,409,805 11/1968 Whipple et al.--.

Column 1, line 39, after "electromagnetic", add --couplers--.
Column 8, line 45, "out" should be --outer--.
Column 9, line 36, "out" should be --outer--.
Column 9, line 43, after "fourth", add --thin film--.

Signed and Sealed this

Twenty-ninth Day of January, 1991

*Attest:*

HARRY F. MANBECK, JR.

*Attesting Officer*

*Commissioner of Patents and Trademarks*